US007114875B2

(12) United States Patent
Romier et al.

(10) Patent No.: US 7,114,875 B2
(45) Date of Patent: Oct. 3, 2006

(54) METHOD AND APPARATUS FOR LAYING HOT BLACKTOP PAVING MATERIAL

(75) Inventors: Alain Romier, St Germain les Arpajon (FR); Yves Martineau, Versailles (FR); Jacques David, Paris (FR); Maurice Audeon, Le Plessis-Grohan (FR)

(73) Assignee: HTP EST, Melun (FR)

( * ) Notice: Subject to any disclaimer, the term of this patent is extended or adjusted under 35 U.S.C. 154(b) by 0 days.

(21) Appl. No.: 10/824,880

(22) Filed: Apr. 15, 2004

(65) Prior Publication Data

US 2004/0223808 A1 Nov. 11, 2004

(30) Foreign Application Priority Data

Apr. 18, 2003 (FR) ..... 03 04875

(51) Int. Cl.
*E01C 7/00* (2006.01)

(52) U.S. Cl. ..... 404/72; 404/75

(58) Field of Classification Search ..... 404/118, 404/17, 75, 82, 31, 32, 86, 91, 92, 101, 108, 404/110, 111
See application file for complete search history.

(56) References Cited

U.S. PATENT DOCUMENTS

| | | | | |
|---|---|---|---|---|
| 2,917,395 | A | 12/1959 | Csanyi | 106/122 |
| 4,464,285 | A | 8/1984 | Schilling | 252/311.5 |
| 5,047,457 | A * | 9/1991 | Higgins | 524/60 |
| 5,590,976 | A * | 1/1997 | Kilheffer et al. | 404/72 |
| 5,944,885 | A | 8/1999 | Yoshinaka et al. | 106/281.1 |
| 6,186,700 | B1 * | 2/2001 | Omann | 404/79 |
| 6,588,973 | B1 * | 7/2003 | Omann | 404/17 |
| 6,599,057 | B1 * | 7/2003 | Thomas et al. | 404/72 |
| 6,682,593 | B1 * | 1/2004 | Burch | 106/222 |

FOREIGN PATENT DOCUMENTS

| | | |
|---|---|---|
| DE | 1 594 811 | 7/1970 |
| EP | 0 466 526 | 1/1992 |
| EP | 0 545 740 | 6/1993 |
| EP | 0 552 574 | 7/1993 |
| EP | 0 524 031 | 1/1995 |
| EP | 0 781 887 | 8/2002 |
| FR | 1 443 136 | 4/1968 |
| FR | 2 117 156 | 7/1972 |
| FR | 2 119 981 | 1/1974 |
| FR | 2 526 675 | 8/1984 |
| FR | 2 612 533 | 9/1988 |
| FR | 2 678 653 | 1/1993 |
| FR | 2 689 051 | 10/1993 |
| FR | 2 705 699 | 12/1994 |
| FR | 2 725 196 | 4/1996 |
| FR | 2 794 468 | 12/2000 |

(Continued)

OTHER PUBLICATIONS

Preliminary French Search Report, Application No. FR0304875, dated Dec. 22, 2003.

*Primary Examiner*—Raymond W Addie
(74) *Attorney, Agent, or Firm*—McCracken & Frank LLP

(57) ABSTRACT

A method of laying hot blacktop paving material, the method comprising a spreading step during which the material is spread onto a surface for receiving it, and immediately prior to the spreading step, a step of adding water during which water plus wetting agent is mixed with the blacktop material.

8 Claims, 1 Drawing Sheet

FOREIGN PATENT DOCUMENTS

| | | |
|---|---|---|
| FR | 2 810 663 | 12/2001 |
| GB | 1 109 893 | 4/1968 |
| GB | 1 130 332 | 10/1968 |
| GB | 1 340 762 | 12/1973 |
| GB | 1 378 386 | 12/1974 |
| SU | 1 276 724 | 12/1986 |
| WO | WO 84/02709 | 7/1984 |
| WO | WO 95/22661 | 8/1995 |
| WO | WO 96/04427 | 2/1996 |
| WO | WO 99/51677 | 10/1999 |
| WO | WO 02/16499 | 2/2002 |

* cited by examiner

METHOD AND APPARATUS FOR LAYING HOT BLACKTOP PAVING MATERIAL

The present invention relates to methods and apparatuses for laying blacktop paving material while hot.

More particularly, the invention relates to a method of laying a blacktop material while hot (i.e. at a temperature above the ambient temperatures commonly encountered in temperate countries), which material comprises bitumen-coated aggregate, the method including a spreading step during which said blacktop material is spread onto a surface that is to receive it, e.g. a road or the like.

BACKGROUND OF THE INVENTION

A blacktop material that is laid while hot always comprises a mix of a mineral aggregate skeleton coated in hot bitumen. Attempts are made to keep its temperature high until it has finished being laid, which generally occurs within the two hours following fabrication and transport to the site where it is laid. This laying consists in distributing the mixture over the surface to be covered in a layer of thickness that is defined, regular, and uniform, e.g. in order to constitute a layer of a roadway (a top layer or a bed layer) or of a similar work. The hot blacktop material is generally laid using a road surfacing machine which performs all of the mechanical functions that are required, and that are accompanied in the final stage by passing compactors over the freshly-spread layer, which compactors serve to densify the mixture.

During these various stages, it can happen that the temperature of the mixture drops below the acceptable limit for satisfactory laying. In addition, it can be advantageous to fabricate paving material at relatively low temperature, for example as described in the patent application filed on the same day as the present patent application by the same Applicant.

OBJECTS AND SUMMARY OF THE INVENTION

A particular object of the invention is to improve the ease of handling of the blacktop paving material in order to make it easier to lay, in particular in the above-mentioned circumstances of laying at low temperature (but not exclusively in such circumstances).

To this end, according to the invention, a method of the kind in question further comprises, immediately before the spreading step, a step of adding water during which water plus wetting agent is mixed with the blacktop material.

By means of these dispositions, it has been found that the ease of handling of the blacktop material is considerably improved by creating an emulsion of water in bitumen, of the water-in-oil type, thus making spreading and distribution easier and compacting satisfactory even when the blacktop material is at relatively low temperature.

In preferred embodiments of the invention, recourse may optionally further be had to one or more of the following dispositions:

- the water plus wetting agent presents a molar concentration of wetting agent lying in the range 0.1% to 1.5%;
- during the step of adding water, the water plus wetting agent is added to the blacktop material at a weight concentration of 1% to 5% relative to the weight of the blacktop material;
- the water plus wetting agent is mixed with the blacktop material by kneading;

- the bitumen of the blacktop material is in a non-foamy fluid state during the steps of adding water and spreading;
- the blacktop material is at a temperature lying in the range 60° C. to 100° C. during the steps of adding water and spreading; and
- the blacktop material is at a temperature lying in the range 100° C. to 130° C., and preferably about 110° C. during the steps of adding water and spreading.

Furthermore, the invention also provides apparatus for implementing the method as defined above, the apparatus comprising mixer means receiving the blacktop material and provided with at least one water inlet fed with water plus wetting agent, and a spreader device receiving the material from the mixer means and adapted to spread the blacktop material. Advantageously, the apparatus includes metering means for metering out the water plus wetting agent.

BRIEF DESCRIPTION OF THE DRAWING

Other characteristics and advantages of the invention appear from the following description of an embodiment thereof given by way of non-limiting example and with reference to the accompanying drawing.

In the drawing.

MORE DETAILED DESCRIPTION

Figure 1:
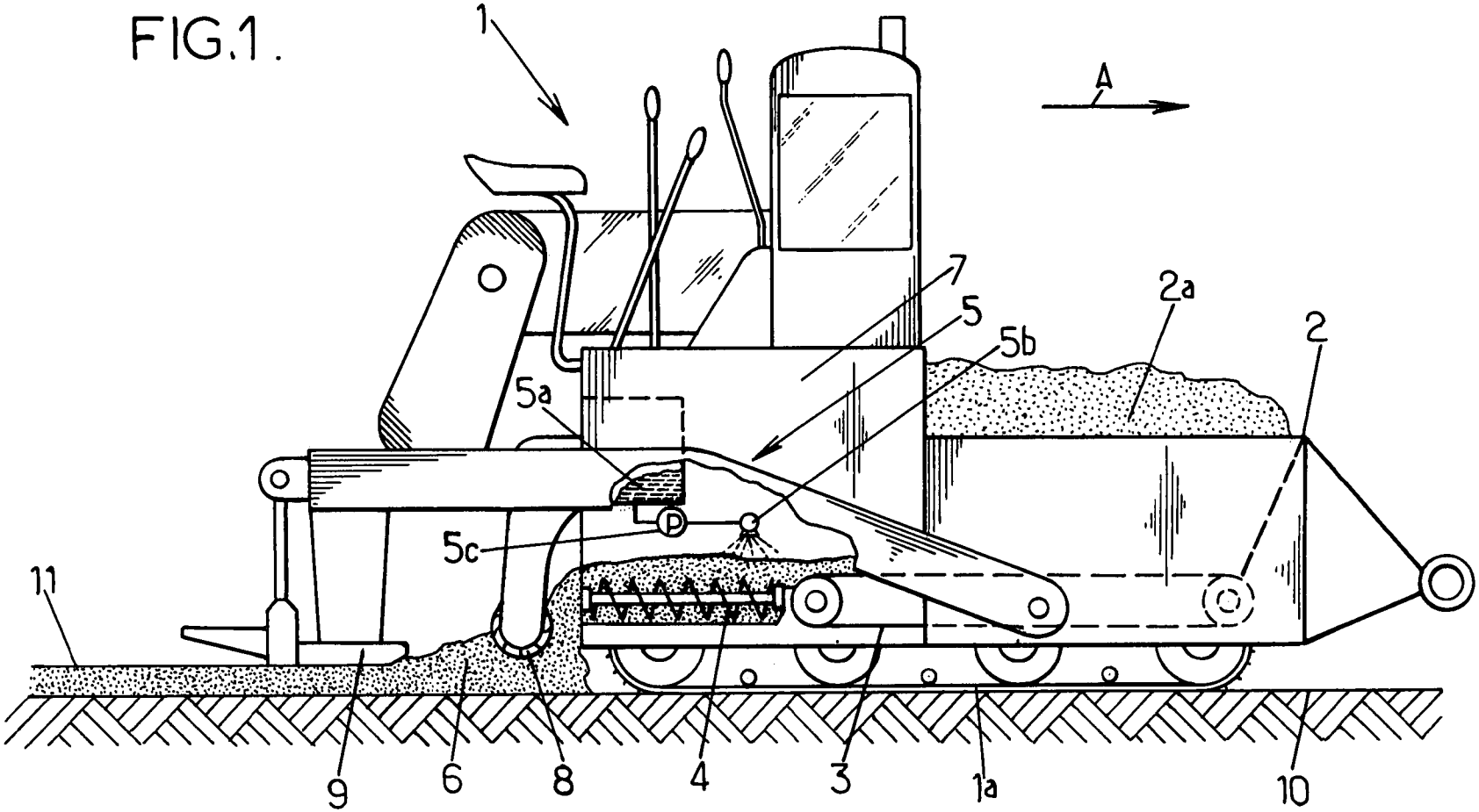
FIG. 1 is an outline diagram showing an embodiment of apparatus for implementing the method of the invention.

The purpose of the method of the invention is to make it easy to lay blacktop paving material comprising bitumen-coated aggregate, and to do so in particular at relatively low temperature.

As shown in the drawing, the method of the invention can be implemented, by way of example, using a road surfacing machine 1 comprising:

- a hopper 2 for receiving hot blacktop material, e.g. at a temperature lying in the range 60° C. to 140° C., for example in the range 60° C. to 100° C., or in the range 100° C. to 130° C., and preferably about 110° C., which material may be of the non-foamed type, for example;
- a conveyor 3 such as a conveyor belt which transfers the blacktop paving material generally from the receiving hopper 2 in a rearward direction, i.e. in the direction opposite to the direction A in which the machine 1 advances;
- a kneader 4 or other mixer device which receives the blacktop material from the conveyor 3 and which is provided with a device 5 for feeding water plus additives, the additives including at least one wetting agent, the kneader being adapted to mix the blacktop material with the water plus wetting agent plus any other additives;
- an engine unit 7 for driving the moving parts of the machine 1; and
- spreader means for spreading the material and comprising:
  - one or more distributor screws 8 for distributing the material 6 transversely over the entire spreading width, the material 6 being poured onto a surface 10 for receiving it on leaving the kneader or other mixer device 4; and
  - a floating table constituted by a smoothing beam 9 fitted with vibrators and/or tampers, either a rigid beam or a beam provided with a plurality of extensible portions enabling the spreading width to be varied while maintaining the surface state and the thickness of the layer 11 that has been distributed.

The water feed device 5 may comprise, for example, a tank 5*a* of water plus wetting agents, a water feeder 5*b* such as a plurality of sprinkler strips or the like, and a variable rate metering pump 5*c* which enables the water feeder 5*b* to receive water from the tank 5*a*.

By way of non-limiting example, the wetting agent used may be the substance sold under the trademark "CECA L200".

The wetting agent may be mixed with the water at a molar concentration lying in the range 0.1% to 1.5%, for example about 0.3%.

The water plus wetting agent may itself be added to the blacktop material at a weight ratio of water to material lying in the range 0.5% to 5%, this weight ratio being controlled by the metering pump 5*c* which can be servo-controlled, e.g. to the speed of advance of the machine 1 and/or to the quantity of material being laid.

Mixing in the kneader or other mixer device can take place relatively quickly, for example over a period of 10 seconds to 2 minutes. The kneading may optionally be performed by means of a conveyor wormscrew that acts simultaneously as a conveyor and as a kneader. Said mixing may also be performed by means of a transverse distributor screw similar to the above-mentioned distributor screw 8. Mixing may also be performed, not in the machine 1, but optionally in apparatus (not shown) used for feeding the machine 1 with blacktop material.

In all cases, kneading takes place immediately prior to the spreading operations, i.e. immediately prior to passing into the distributor screw 8 and under the smoothing beam 9 (i.e. a few seconds to less than 10 minutes before these operations, for example), and advantageously on the site where laying is taking place.

What is claimed is:

1. A method of laying hot blacktop paving material comprising bitumen-coated aggregate, the method comprising the steps of:

(a) receiving the bitumen-coated aggregate, the bitumen-coated aggregate having been formed by coating the aggregate with bitumen, (b) mixing a mixture consisting essentially of water and wetting agent with the bitumen-coated aggregate to form the blacktop paving material, (c) spreading the blacktop paving material on a surface for receiving the blacktop material immediately after the mixture of water and wetting agent is mixed with the bitumen-coated aggregate.

2. The method of claim 1, wherein the mixture of water and wetting agent has a molar concentration of wetting agent within the range of 0.1% to 1.5%.

3. The method of claim 1, wherein the mixture of water and wetting agent is added to the bitumen-coated aggregate at a weight concentration of 1% to 5% relative to the weight of the bitumen-coated aggregate.

4. The method of claim 1, wherein the mixing of the mixture of water and wetting agent and bitumen-coated aggregate is conducted by kneading.

5. The method of claim 1, wherein the bitumen in the bitumen coated aggregate is in a non-foamy fluid state during the mixing and spreading steps.

6. The method of claim 1, wherein the bitumen-coated aggregate is at a temperature within the range of 60° C. to 100° C. during the receiving step.

7. The method of claim 1, wherein the bitumen-coated aggregate is at a temperature within the range of 100° C. to 130° C. during the receiving step.

8. The method of claim 7, wherein the bitumen-coated aggregate is at a temperature of about 110° C. during the receiving step.

* * * * *